United States Patent [19]

Graf

[11] Patent Number: 4,779,808

[45] Date of Patent: Oct. 25, 1988

[54] GYRATORY CRUSHER

[75] Inventor: Carl R. Graf, Whitehall, Pa.

[73] Assignee: Fuller Company, Bethlehem, Pa.

[21] Appl. No.: 648,623

[22] Filed: Sep. 10, 1984

Related U.S. Application Data

[63] Continuation of Ser. No. 422,789, Sep. 24, 1982, abandoned.

[51] Int. Cl.[4] ..... B02C 2/04

[52] U.S. Cl. ..... 241/30; 241/206; 241/214

[58] Field of Search ..... 241/206–216, 241/30

[56] References Cited

U.S. PATENT DOCUMENTS

| | | | |
|---|---|---|---|
| 326,264 | 9/1885 | Browne . | |
| 1,030,194 | 6/1912 | Lieber | 241/206 |
| 1,031,083 | 7/1912 | Newhouse | 241/206 |
| 2,349,790 | 5/1944 | Johnson | 241/211 |
| 3,227,381 | 1/1966 | Golücke et al. | 241/208 |
| 3,312,404 | 4/1967 | Allen | 241/215 |
| 3,599,883 | 8/1971 | Pollak | 241/213 |
| 3,666,188 | 5/1972 | Lippmann | 241/213 |
| 4,257,564 | 3/1981 | Pamplin | 241/30 |

FOREIGN PATENT DOCUMENTS 579011 11/1977 U.S.S.R. .

*Primary Examiner*—P. W. Echols
*Assistant Examiner*—Joseph M. Gorski
*Attorney, Agent, or Firm*—Frank H. Thomson

[57] ABSTRACT

A gyratory crusher of the type including a frame with a bowl mounted on the frame and a head cooperable with the bowl in crushing operations. The head is rotatably mounted on an eccentric which is driven through suitable gearing. The head is positively rotated by a drive means either independent of or integral with the drive for the eccentric. The bowl is free to rotate about the frame. The rotary motion imparted to the head serves to induce centrifugal force to the particles of material within the crushing chamber. This centrifugal force, when combined with the gravitational force acting on the particles of material, results in the material moving through the crushing chamber in a trajectory which follows the configuration of the crushing chamber.

3 Claims, 2 Drawing Sheets

PRIOR ART
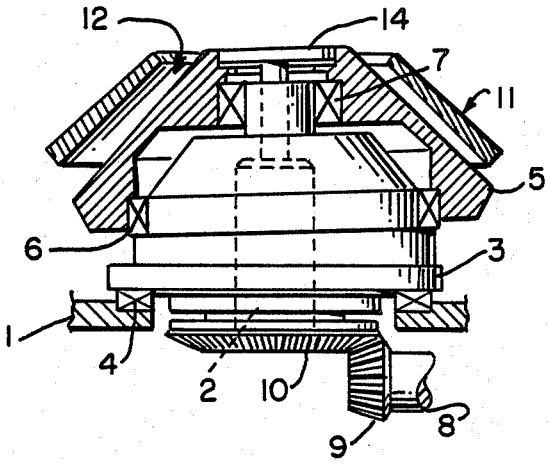
FIG. 1
FIG. 2
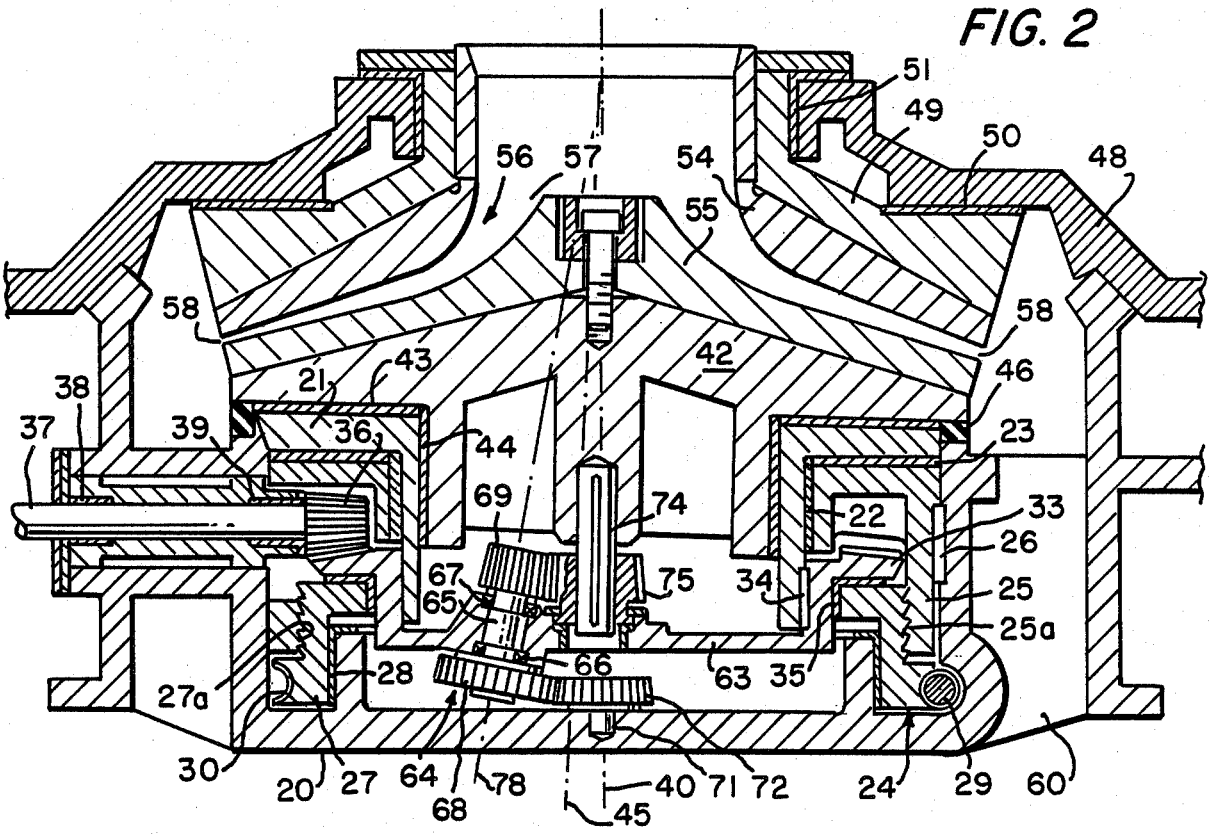
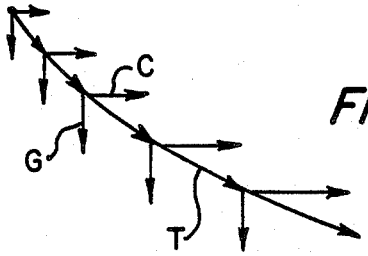
FIG. 3

GYRATORY CRUSHER

This application is a continuation of U.S. patent application Ser. No. 422,789 filed Sept. 24, 1982, abandoned.

BACKGROUND OF THE INVENTION

The present invention relates to gyratory crushers in general and, more particularly, to a gyratory crusher of the type which is designed to be a secondary or tertiary crusher in the size reduction of material being removed from a quarry or mine.

Gyrator crushers typically include a rotary means or eccentric mounted by means of bearings on the frame and in some cases, on a main shaft of the frame. A crushing head is mounted by means of bearings on the eccentric at an angle to the frame. The eccentric is rotated through a drive shaft and gearing and as it rotates relative to the frame, the head of the crusher moves alternately toward and away from the bowl of the crusher in a gyratory manner. As material to be crushed moves through the crushing chamber, it is repeatedly subjected to compressive forces and reduced in particle size. Typically, there is a certain amount of drag in the bearings between the eccentric and the crushing head so that the crushing head not only gyrates but also rotates uninhibited about its own axis at less than 15% of the number of gyrations per minute during the crushing operation. Many crushers prior to the present invention provided some means for preventing rotation of the head or at least reducing the speed or rotation of the head during crushing operations; See U.S. Pat. No. 3,908,912 and the anti-spin mechanism in various other patents.

It is the general object of a rock crusher to reduce the size of the material being supplied to the crushing chamber at as rapid a rate as is practical with the smallest machine practical. Conventionally, material moves through the crushing chamber by the force of gravity and a small amount of movement added to the material by the oscillations of the crushing head. As a result, the material movement through the crusher is generally slow and the material is often subjected to a greater number of compressions than is actually necessary to reduce the size of the material to the desired fineness. As a result, in many instances, more "fines" are produced than is desired. These fines must be screened off in order to achieve the desired product size range. In order to move sufficient material through the crusher to achieve the desired capacity, it has heretofore been necessary to have a large machine.

In order to increase crusher capacity, it would be desirable to arrive at a means and method for moving a greater volume of material through the crusher while still being able to subject this material to sufficient number of impacts or compressions to achieve the desired size reduction. Conventionally, this is done by providing a larger machine or operating a machine at a faster speed.

In an effort to increase the amount of material which can be passed through a gyratory crusher and still achieve the desired size reduction, it has been proposed to rotate the bowl of the crusher relative to the crushing head as shown in U.S.S.R. Author's Certificate No. 579011, published Nov. 5, 1977. According to this publication, centrifugal forces contribute to push material towards the discharge opening of the crusher.

By imparting a centrifugal force to the material being crushed, a generally horizontal force is imparted to the particles of material. Gravitational force imparts a vertical force to the material being crushed. If the centrifugal force imparted to the material can be controlled, then the vector sum of the combined gravitational and centrifugal forces acting on a particle of material within the crushing chamber at any given point can be controlled. The vector sum is such that the material is moved through the crushing chamber at a greater speed. The crushing chamber can then be designed so it generally conforms with the trajectory of material moving through chamber. This means that the crushing chamber can be designed so that the material moves through the crushing chamber at a speed which, when coordinated with movement of the crushing head permits a greater volume of material to be passed through the crusher while achieving the desired size reduction but without compressing the material so many times that additional fines are produced. By being able to move material through the crushing chamber at a faster rate, a given size machine can produce a greater volume of product. In addition, a trajectory path formed by the compression members (head and bowl) which is closely related to the vector sum of the gravitational and centrifugal forces reduces the per ton wear rate of the crushing members.

In order to achieve this desired combination of circumstances, it has been found by the present invention that the means for producing an oscillating motion in the crushing head to thereby subject the material to compressive crushing forces should be capable of being independent of the means for imparting centrifugal force to the material being crushed. This allows a control over each of the functions. The centrifugal force imparted to the material within the crushing chamber can be carried out by positively rotating either the crushing head independently of the gyratory motion induced in the crushing head or by independently rotating the bowl of the crusher, or by rotating both. It has also been found by the present invention that it is only necessary to rotate one of the crushing members, i.e., either the crushing head or the bowl of the cruhser and allow the other curshing member to freely rotate. The material within the crushing chamber thereby acts as a clutch between the two crushing members so that both are positively rotated. It should be noted that both crushing members could be rotated and still be within the concepts of the present invention.

SUMMARY

It is the principle object of this invention to provide a crushing apparatus which is capable of processing a greater volume of material than prior apparatus while still achieving the desired size reduction of the material.

It is a further object of the present invention to provide a crushing apparatus which is capable of processing a large volume of material but reduces the production of undesired oversized and undersized product which requires additional screening capability or generation of waste product.

In general, these and other objects will be carried out by providing apparatus for crushing material comprising first and second crushing members defining a crushing chamber therebetween; first means for producing a gyratory motion in one of said crushing members whereby said one of the crushing members moves alternately toward and away from the other crushing member to thereby impart crushing forces to material within the crushing chamber; and second means for producing a rotary motion in one of said crushing members for imparting centrifugal force to the material within the crushing chamber; said second means being variable from and operating at a speed different from said first means.

The foregoing and other objects of the invention will also be carried out by providing a method of crushing material comprising the steps of providing first and second crushing members which define a crushing chamber; causing at least one of the crushing members to move alternately toward and away from the other crushing member to thereby impart a crushing force to material within the crushing chamber; and independently inducing a motion to the material being crushed which motion has a primary component in a direction to advance material through the crushing chamber.

BRIEF DESCRIPTION OF THE DRAWINGS

The invention will be described in connection with the annexed drawing wherein:

FIG. 1 is a diagrammatic view partially in section of a crusher of the prior art;

FIG. 2 is a sectional view of a crusher according to the present invention; and

FIG. 3 is a diagram of the trajectory of a particle of material moving through the crushing chamber of the present invention.

DESCRIPTION OF THE PREFERRED EMBODIMENT

Figure 4:
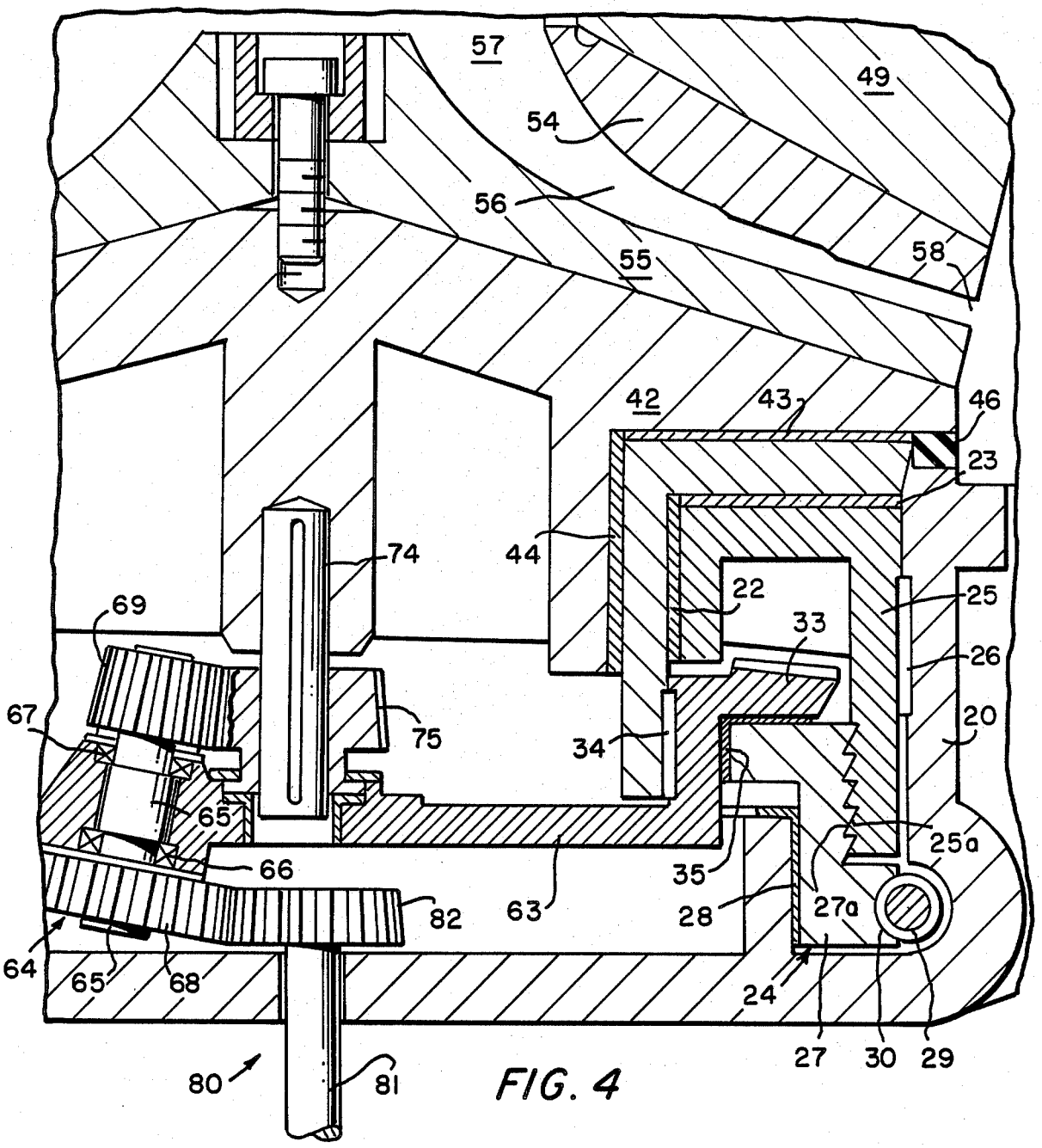
FIG. 4 is a view similar to FIG. 4 showing a modification of the present invention.

Referring to FIG. 1, a typical prior art crusher includes a frame 1 having a main shaft 2 and an eccentric or rotary means 3 rotatably mounted on the shaft 2 and frame 1 by means of bearings 4. A crushing head 5 is rotatably mounted by means of bearings 6 and 7 on the eccentric 3. A suitable drive mechanism formed by a drive shaft 8 and gearing 9 and 10 serves to rotate the eccentric 3 to impart an oscillating or gyratory motion to the crushing head 5. The crusher also includes a bowl 11 which with the head 5 defines a crushing chamber 12. As eccentric 3 is rotated around the main shaft 2, the head 5 moves alternately toward and away from the bowl 11 in a gyratory manner to thereby impart compressive forces to material within the crushing chamber 12 and crush the material.

In most compression crushers available in the marketplace today, gravitational force is the primary motive force which advances material through the crushing chamber 12. The oscillations of the head 5 serve to induce some movement of the material through the crusher, but this is limited due to the desire to keep the magnitude of the oscillating movement of the head within reasonable limits.

In many crushers, it is not unusual to include a means 14 for preventing the head 5 from rotating with the eccentric 3.

It has been found by the present invention that it is desirable to induce a centrifugal force in the particles being crushed so that a generally horizontal component of force is imparted to the material being crushed to thereby permit a faster movement of material through the crushing chamber. One means for carrying out this concept is illustrated in FIG. 2.

In FIGS. 2 and 4, the crusher includes a frame 20 which may be similar to the frame of a crusher of the prior art. A rotary means on eccentric 21 is rotatably mounted in the frame 20 by means of bearings 22 and 23 through an adjusting mechanism generally indicated at 24.

The adjusting mechanism 24 includes an annular support member 25 which is keyed at 26 to the frame 20 to permit the member 25 to move vertically relative to the frame. The support 25 is provided with internal screw threads 25*a*. An annular adjusting member 27 is rotatably mounted on frame 20 by means of bearing 28. Annular support member 25 is connected to member 27 through threads 25*a* and 27*a*. A worm gear 29 engages teeth 30 on the outer periphery of annular member 27. When the worm 29 is rotated, member 27 is rotated causing the vertically movable, rotatably fixed annular member 25 to move in a vertical direction by means of the threaded connection 25*a*–27*a* to thereby provide a means for adjusting the vertical position of the eccentric 21.

A ring gear 33 is keyed at 34 to the eccentric 21. Bearings 35 are used between the ring gear 33 and annular adjusting member 27. A bevel gear 36 mounted on a shaft 37 engages gear 33. Shaft 37 is mounted in bearings 38 and 39 in the frame 20 in a well-known manner and adapted to be connected to a motor (not shown). Thus, the motor, the shaft 37 and gears 36 and 33 and key 34 define a means for rotating the eccentric 21.

A crusher head 42 is rotatably mounted on the eccentric 21 by means of bearings 43 and 44. As is typical in a crusher of this type, the head 42 is mounted so that its axis 45 is at an angle to the centerline or axis 40 of the crusher and the centerline of the eccentric. The centerline of this eccentric may, if desired, be parallel to but offset from the centerline of the crusher. Due to the angled crushing head, as the eccentric 21 is rotated, the head 42 gyrates or oscillates relative to the crusher frame 20.

A seal 46 may be provided around the periphery of the head 42 to prevent crushed rock from entering the various bearings.

The crusher frame includes an upper shell 48 having a bowl or concave 49 rotatably mounted on the frame 20 by means of bearings 50 and 51. The bowl 49 is aligned with the axis 40 of the crusher.

Wearable material 54 is mounted by conventional means on the bowl 49. Wearable material 55 is also mounted on the head 42 and defines therebetween a crushing chamber 56 having an inlet 57 and an outlet 58. The adjusting mechanism 24 serves to move the head 42 toward or away from the bowl 49 to thereby vary the discharge size of the crushing chamber 56. As is well known to those skilled in the art, this adjustment permits changing the product size and permit adjustment of the crusher to compensate for wear of the wearable material 54 and 55.

In general, crushing takes place by one of the crushing members defined by the head 42 and wearable material 55 alternately moving toward and away from the other crushing member defined by bowl 49 and wearably material 54 so that a crushing or compressive force is imparted to material within the crushing chamber. Thus, the drive shaft 37, gearing 36 and 33 and rotary means 21 define a means for causing one of the crushing members to move alternately toward and away from the other crushing member of a first means for producing a gyratory motion in one of the crushing members whereby said one of the crushing members moves alternately toward and away from the other cruhsing member to impart crushing forces to material within the crushing chamber 56. Large pieces of stone to be crushed are supplied from the primary crusher of quarry to the inlet 57 of the crushing chamber. The movement of the head toward the bowl imparts crushing forces to the material to break it into smaller pieces. When the head moves away from the bowl, these broken pieces fall by means of gravity through the crushing chamber 56. This movement is stopped when material is again pinched between the two crushing members and the material is further broken. This action is repeated until the material is discharged from the crushing chamber 56 through outlet 58 and material is discharged from the crusher through outlet 60.

In a conventional crusher such as shown in FIG. 1, in order to increase production, the crusher is operated at a higher speed with consequent larger motions and thicker material streams. The result is that the head 5 moves toward and away from the bowl 11 more times so that the material is subjected to a greater number of impacts. The result is a greater production of fine material which in many instances must be screened off to produce the desired product. Another manner of increasing production is to use a larger machine.

By the present invention, I have provided a means for increasing the amount of material which can be put through the machine while achieving the desired size reduction, but without producing excessive fines or oversize product. This will reduce the amount of screening required to obtain the desired finished product size. In general, this is carried out by providing an independent means for producing a rotary motion to one of the crushing members which rotary motion imparts a centrifugal force to material within the crushing chamber.

The means for imparting centrifugal force includes a planetary gearing means 64 mounted on the hub 63 of ring gear 33. The planetary gearing means includes a shaft 65 rotatably mounted by means of bearings 66 and 67 in an enlarged portion of hub 63. Gears 68 and 69 are mounted on shaft 65. In FIG. 2 an independent shaft 71 is fixed to frame 20 and has mounted thereon a fixed gear 72 which meshes with gear 68 of planetary means 64. A shaft 74 is keyed to the head 42 and gear 75. The gear 75 is mounted on the eccentric or rotary means 21 and is secured thereto by bearings allowing the gear to rotate at a speed independent of the eccentric speed. The shaft 74 and gear 75 are designed to extend into but rotate relative to hub 63 and ring gear 33.

In operation of the crusher, the drive shaft 37 is driven by a motor means to rotate gear 36 and ring gear 33 to cause head 42 to gyrate as described above. Rotation of ring gear 33 about its own axis causes planetary gear means 64 to revolve about the axis of the ring gear. Due to the gears 68 and 69 being mounted on the shaft 65, when planetary means 64 revolves around fixed, frame gear 72, gear 68, shaft 66 and gear 69 are rotated. The rotation of gear 69 produces a rotary motion in meshing gear 75 to thereby rotate head 42 relative to frame 20.

The planetary means 64 is mounted so that its axis 78 is at an angle to both the axis of the eccentric 21 and the head 42.

By varying the relationship to each other of the reduction ratios of the gears 68, 72, 69, and 75, the head 42 can be rotated at a desired speed independent of the speed at which the head moves alternately toward and away from the bowl or concave 49. While the drive means 64, 72, 74, and 75 receives its driving force from the same source as the direct drive 37, 36, 33 for the eccentric 21, the gearing used makes the rotational drive independent or variable from the drive which produces the gyratory motion.

Rotation of the head 42 serves to impart a centrifugal force to particles of material within the crushing chamber 56. This centrifugal force acts horizontally on the material being crushed and when combined with the gravitational forces acting on the material within the crushing chamber serves to produce a resultant vector. In FIG. 3, the gravitational force at any given point within the crushing chamber 56 is indicated by the vector G and the centrifugal force at that point is indicated by the vector C.

While the gravitational force is constant, the velocity of the head 42 at the crushing chamber or surface of the wearing material 54 increases toward the bottom of the crushing chamber so that the centrifugal force imparted to a particle of material in the crushing chamber 56 will, in the configuration shown, also increase. As a result, the trajectory of a particle of material may, at least to a certain extent, be controlled. One such trajectory is shown in FIG. 3 and designated at T. With the present invention, the crushing chamber is designed so that it has a configuration which is generally in accordance with the designed trajectory. This permits a crushing chamber which allows the maximum amount of material to be moved through the crusher by the combined gravitational/centrifugal forces yet the material will be sujected to sufficient impacts to produce the desired size reduction. In addition, because the crushing chamber 56 closely approximate the trajectory of material moving therethrough, wear of the material 54, 55 will be reduced.

Thus, a means has been defined for independently inducing a motion to the material being crushed, which motion has a primary component in a direction to advance material through the crushing chamber. The trajectory T can have a steeper angle or more vertical than illustrated in FIG. 3 by reducing the centrifugal force by reducing head rotational speed. The crushing chamber can have a path so that trajectory T is more horizontal by increasing the speed of rotation of the head 42 so that a greater centrifugal force is imparted to the material to be crushed. If the shape of the crushing chamber is flattened, this greater centrifugal force can serve to increase the speed at which the material moves through the crushing chamber.

While the centrifugal force serves to aid in the movement of material thorugh the crusher, the conventional rotary means 21, and direct drive means 37, 36, and 33 serves to control the number of times material is subjected to crushing forces during the movement through the crushing chamber 56. The fact that the second drive means 64, 72, 74, and 75 for imparting a centrifugal force to the material is independent of or variable from the means 37, 36, and 33 for imparting crushing forces to the material allows a machine to be designed which permits maximum throughput for a desired size reduction. The speed of the gyratory motion is coordinated with the speed of the rotation motion so that material moves through the crushing chamber at the desired rate while achieving the desired size reduction. The actual speeds and their relationship to each other will depend upon the capacity desired, the size reduction desired and the material being crushed.

By the present invention, it is believed that in order to achieve the desired centrifugal force on the material being crushed, it is necessary to have the bowl freely rotatable. The material within the crushing chamber acts as a clutch between the two crushing members. If one of the crushing members were fixed and the other driven, excessive forces would be placed on the machine.

From the foregoing, it can be seen that a novel method of crushing material has been devices which includes causing a crushing member, i.e., the head, to move alternately toward and away from the crushing member, i.e., the bowl, to thereby impart crushing forces to material within the crushing chamber. The method also includes independently inducing a motion of the material being crushed which motion has a primary component in a direction to advance material thorugh the crushing chamber. This independent motion is accomplished by rotating the head independently of the gyratory motion imparted to the head. The rotary motion of the head imparts a centrifugal force to the material within the crushing chamber and this centrifugal force combined with the gravitational force acting on the particles of material serves to advance material through the crushing chamber.

While in the embodiment shown in FIG. 2 the head is driven to provide the means for imparting a centrifugal force to the material, in other embodiments, it may be desirable to positively rotate the bowl and have the head freely rotatable. It may also be desirable to positively rotate both. Other arrangements may also be used for the drive of the head; some of which may utilize an independent motor for rotating the head, and employ suitable gearing to achieve the desired independent control. One such configuration is shown in FIG. 4.

Referring to the embodiment of FIG. 4 wherein like numerals reference like parts, there is provided a separate drive means generally indicated at 80 for producing rotary motion of the crushing member 42. In this embodiment, the second drive means 80 includes a drive shaft 81 adapted to be connected to a motor (not shown) and a sun gear 82 which takes the place of the fixed gear 72 of the embodiment of FIG. 3 and meshes with planetary gear 68 of means 64.

The positive rotation of gear 82 produces a positive rotation of gear 68 and has gear 69 to rotate head gear 75 and thus crushing member 42. The embodiment of FIG. 4 thus provides not only an independent means for rotating head 42 and thus imparting centrifugal force to particles within the crushing chamber, but also a means for positively rotating head 42.

It should be pointed out that while the invention has been illustrated in connection with a sleeve bearing type crusher, it is to be understood that its principle can be applied to any gyratory crusher.

From the foregoing, it should be apparent that the invention has been described as a preferred embodiment. It is intended, however, that the invention be limited solely by that which is within the scope of the appended claims.

I claim:

1. A method of crushing material comprising the steps of providing a crusher including a bowl rotatable about its own axis and a head cooperating with said bowl to define a crushing chamber therebetween having an inlet and an outlet; providing the crushing chamber with a curved shape that is flatter at its outlet than at its inlet; inducing a gyratory motion in the head to cause the head to move alternately toward and away from the bowl to impart a crushing force to material in the crushing chamber; positively and independently rotating the head at a speed to impart centrifigal force to particles of material in the crushing chamber which centrifugal force combines with gravitational force acting on particles of material in the crushing chamber to move material through the crushing chamber on a curved trajectory; controlling the speed at which the head is rotated to control the amount of centrifugal force applied to particles of material in the crushing chamber whereby when the speed of rotation is increased the centrifugal force increases and the trajectory of material moving through the crushing chamber becomes flatter; and coordinating the speed of rotation of the head with the shape of the crushing chamber so that the trajectory of material moving through the crushing chamber substantially conforms with the shape of the crushing chamber.

2. A rock crusher comprising:

a frame;

a bowl rotatably mounted on said frame and free to rotate about its own axis;

a head cooperable with said bowl to define a crushing chamber therebetween;

an eccentric rotatably mounted on said frame and operatively connected to said head;

first means for rotating said eccentric for causing said head to gyrate relative to said bowl including a ring gear secured to said eccentric and a drive shaft operatively connected to said ring gear;

second means for positively rotating said head relative to said eccentric for imparting a centrifugal force to particles of material in the crushing chamber which centrifugal force when combined wih gravitational force acting on the particles of material move the particles of material through the crushing chamber on a trajectory;

said second means including a planetary gear means mounted on said ring gear, a sun gear operatively connected to a second drive shaft and said panetary gear means, and a head gear operatively connected to said head and to said planetary gear means and head gear whereby said head is positively rotated by said second drive shaft, sun gear, planetary gear means;

said crushing chamber having an inlet and an outlet and having a configuration that is flatter at its outlet than at its inlet and substantially conforms in shape to the trajectory of particles of material moving through the crushing chamber.

3. A rock crusher comprising:

a frame;

a bowl rotatably mounted on said frame;

a head cooperable with said bowl to define a crushing chamber therebetween having an inlet and an outlet and a configuration which is flatter at its outlet than at its outlet than at its inlet;

an eccentric rotatably mounted on said frame and operatively connected to said head;

first means for rotating said eccentric for causing said head to gyrate relative to said bowl to exert a crushing force on material within the crushing chamber including a ring gear secured to said eccentric and a drive shaft operatively connected to said ring gear; and second means for postively rotating said head relative to said eccentric for imparting a centrifugal force to particles of material in the crushing chamber which centrifugal force when combined with gravitational force acting on the particles of material move particles of material through the crushing chamber on a trajectory; ;

said second means including a planetary gear means, a frame gear mounted on said frame, a head gear mounted on said head and said planetary gear means is adapted to revolve around said frame gear to thereby rotate said head gear and said head;

said crushing chamber having a shape that substantially conforms to the trajectory of particles of material moving through the crushing chamber.

* * * * *